United States Patent [19]

Puccetti et al.

[11] 4,058,268

[45] Nov. 15, 1977

[54] SELF-LOCKING SUPPORT FOR TUBULAR MEMBERS

[75] Inventors: Ralph P. Puccetti, Oak Park; King L. Klopfenstein, Prospect Heights, both of Ill.

[73] Assignee: Triangle Package Machinery Company, Chicago, Ill.

[21] Appl. No.: 726,623

[22] Filed: Sept. 27, 1976

[51] Int. Cl.[2] ..... B65H 75/24

[52] U.S. Cl. ..... 242/72 R

[58] Field of Search ..... 242/68.3, 68.2, 68, 242/68.1, 72, 46.4

[56] References Cited

U.S. PATENT DOCUMENTS

| | | | |
|---|---|---|---|
| 1,673,444 | 6/1928 | Derry | 242/72 |
| 3,419,227 | 12/1968 | Werkmeister | 242/72 |
| 3,768,749 | 10/1973 | Fredrickson | 242/72 |

*Primary Examiner*—Edward J. McCarthy
*Attorney, Agent, or Firm*—Emrich, Root, O'Keeffe & Lee

[57] ABSTRACT

A self-locking support for tubular members embodying two annular supporting members eccentrically mounted on a shaft and rotatable relative to each other.

8 Claims, 6 Drawing Figures

FIG. 1
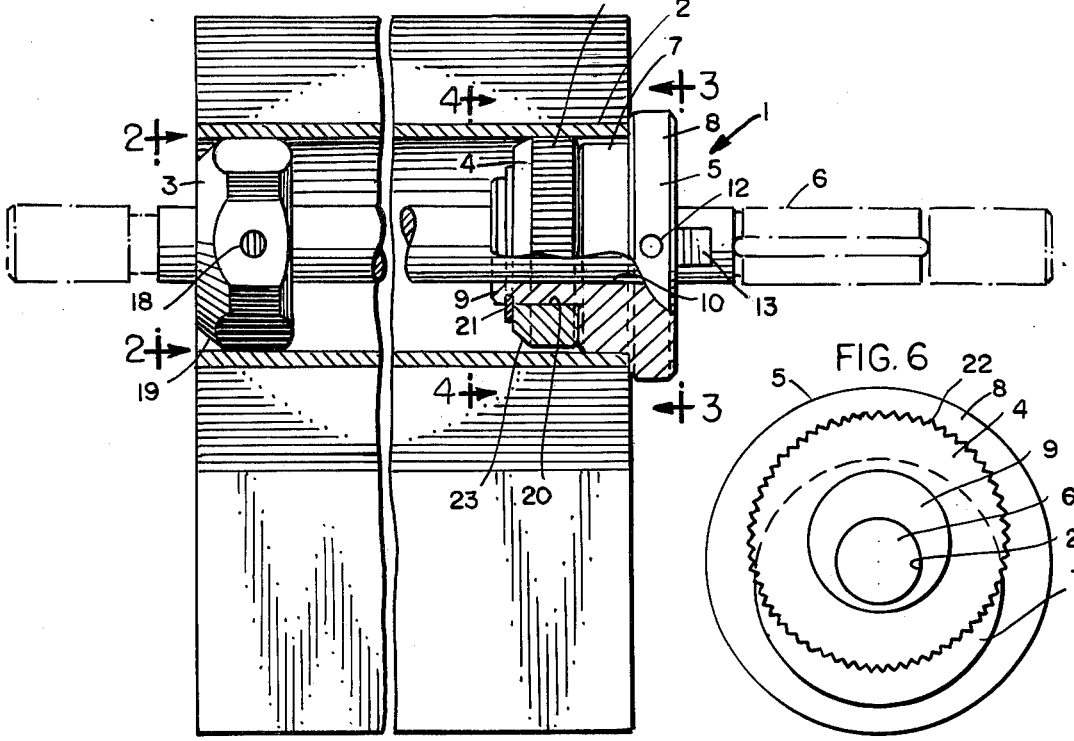
FIG. 6
FIG. 2
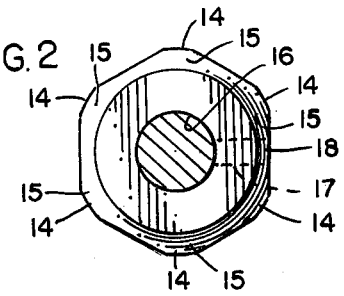
FIG. 3
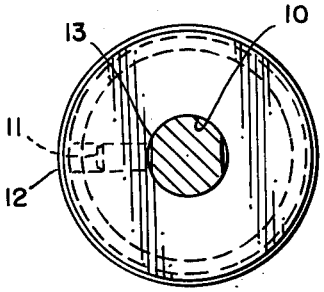
FIG. 5
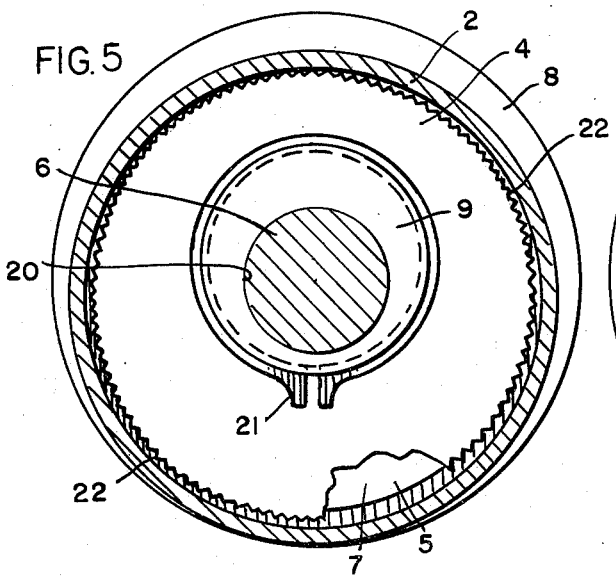
FIG. 4
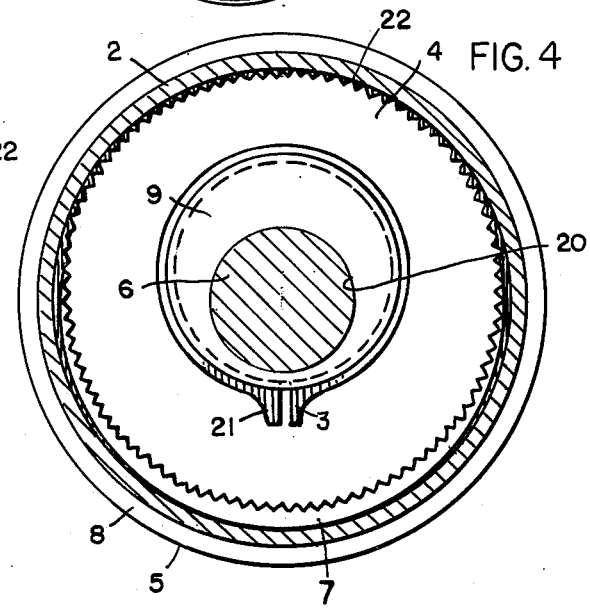

SELF-LOCKING SUPPORT FOR TUBULAR MEMBERS

BACKGROUND OF THE INVENTION

This invention relates to supports for tubular members, and, more particularly, to supports for rotatably supporting tubular members.

It is a primary object of the present invention to afford a novel support for tubular members.

Another object is to afford a novel support for rotatably supporting tubular members.

Another object of the present invention is to afford a novel support for tubular members, which is particularly well adapted for rotatably supported tubular members which form the cores of rolls of material, such as, for example, rolls of paper or film used in the bag making field, and the like.

A further object of the present invention is to afford a novel support for supporting tubular members on rotating shafts, wherein the parts of the support are so constituted and arranged as to effectively releasably secure the tubular members to the shafts in a novel and expeditious manner for rotation therewith.

An object ancillary to the foregoing is to afford a novel support of the aforementioned type which is operable in a novel and expeditious manner to release such a tubular member from secured relation to such a shaft.

Various supporting mechanisms for securing tubular members, such as, for example, the aforementioned tubular members which may form the cores of rolls of paper or film, and the like, on shafts for rotation with the shafts have been heretofore known in the art. Such mechanisms have included cones that were driven or otherwise axially forced into the ends of such tubular members with a force fit, with the cones being secured to the shafts. Such mechanisms have also included spider-type expanding mechanisms that can be mounted on and secured to such a shaft within a tubular member and expanded outwardly into securing engagement with the tubular member.

Securing mechanisms heretofore known in he art for releasably securing tubular members to shafts for rotation therewith have had several inherent disadvantages, such as, for example, being complicated in construction and operation; being unreliable in operation; requiring repositioning or re-checking of the positioning of the securing mechanisms on the shafts when tubular members were changed; or being difficult and expensive to produce commercially, and the like. It is an important object of the present invention to overcome such disadvantages.

Another object of the present invention is to afford a novel support for tubular members, embodying a novel double-eccentric locking mechanism for holding a tubular member in stationary position relative to a shaft disposed therein.

Another object of the present invention is to afford a novel support for a tubular member for securing the tubular member to a shaft, and which support embodies an annular member having a flange abuttingly engaged with the end of the tubular member, when the latter is disposed in operative position on the shaft, and which annular member may remain in stationary position on the shaft when tubular members of the same size are being substituted for each other, so as to insure that, when the substituted tubular member is disposed on the annular member in abutting engagement with the flange, the tubular member is properly positioned axially of the shaft.

A further object of the present invention is to afford a novel supporting mechanism, for supporting tubular members on shafts, which is practical and efficient in operation and may be readily and economically produced commercially.

Other and further objects of the present invention will be apparent from the following description and claims and are illustrated in the accompanying drawings, which, by way of illustration, show a preferred embodiment of the present invention and the principles thereof and what we now consider to be the best mode in which we have contemplated applying these principles. Other embodiments of the invention embodying the same or equivalent principles may be used and structural changes may be made as desired by those skilled in the art without departing from the present invention and the purview of the appended claims.

DESCRIPTION OF THE DRAWINGS

In the drawings:

FIG. 1 is a fragmentary side elevational view, with certain parts broken away to show underlying parts, of a support embodying the principles of the present invention, and showing the support disposed in supporting and locked relation to the tubular core of a roll of paper or film, or the like;

FIG. 2 is a detail sectional view taken substantially along the line 2—2 in FIG. 1;

FIG. 3 is a detail sectional view taken substantially along the line 3—3 in FIG. 1;

FIG. 4 is a detail sectional view on an enlarged scale taken substantially along the line 4—4 in FIG. 1;

FIG. 5 is a detail sectional view, similar to FIG. 4, but showing the parts of the supporting mechanism disposed in different operative position; and FIG. 6 is a detail sectional view, similar to FIG. 5, but showing the parts of the supporting mechanism in yet another operative position.

DESCRIPTION OF THE EMBODIMENT SHOWN HEREIN

A supporting mechanism 1, embodying the principles of the present invention is shown in the drawings to illustrate the presently preferred embodiment of the present invention.

The supporting mechanism 1 is shown in FIG. 1 mounted in a tubular member 2, which may form the core for a roll of sheet material such as, for example, paper or film, or the like. However, this is merely by way of illustration and not by way of limitation, and the supporting mechanism 1 may be used for supporting other types of tubular members without departing from the purview of the present invention.

The supporting mechanism 1, shown in the drawings, embodies three annular members 3, 4 and 5 mounted on a suitable shaft 6, which may be journaled in any suitable structure, not shown, such as, for example, a bag-making machine, or the like. They may be made of any suitable material, such as, for example, aluminum.

The annular member 5 preferably is of one-piece construction and embodies a central body portion 7 having a radially outwardly projecting flange portion 8 disposed on one side thereof and a hub portion 9, of reduced cross-sectional size, disposed on the side thereof remote from the flange 8. The outer peripheries of the portions 7–9 preferably are circular in shape, and a round opening 10 extends through the portions 7–9 of the annular member 5. The outer periphery of the flange portion 8 is larger in diameter than the outer periphery of the body portion 7 and projects radially outwardly therebeyond in all directions. Likewise, the outer periphery of the body portion 7 is of greater diameter than the outer periphery of the hub portion 9 and projects radially outwardly therebeyond in all directions.

Preferably, the outer periphery of the flange portion 8 is concentric to the opening 10. However, the outer peripheries of the body portion 7 and the hub portion 9 are eccentric to the opening 10, for a reason which will be discussed in greater detail presently, and in the preferred form of the supporting mechanism 1, they are eccentric in opposite directions to the opening 10, such as, for example, with the body portion 7 being eccentric directly downwardly, and the hub portion 9 being eccentric directly upwardly, as viewed in FIGS. 3–6.

The annular member 5 may be stationarily secured to the shaft 6 by any suitable means such as a set screw 11, threadedly engaged in an opening 12 in the flange portion 8 and suitably abuttingly engaged with the shaft 6, such as, for example, with a flat 13 formed on the outer periphery thereof, FIGS. 1 and 3.

The annular member 3, shown in the drawings is hexagonal in transverse cross-sectional shape, FIGS. 1 and 2. The outermost periphery of the annular member 3, defined by the outer extremities 14 of the lobes 15 of the hexagonal outer surface of the annular member 3 preferably is substantially circular in shape, and is disposed in concentric relation to a round opening 16 extending axially through the annular member 3, FIG. 2. The annular member 3 in the assembled supporting mechanism 1, shown in the drawings, is disposed in axially spaced relation to the annular member 5, and may be releasably, stationarily secured to the shaft 6 for rotation therewith by any suitable means such as a set screw 17 threaded into an opening 18 in the periphery of the annular member 3 and abuttingly engaged with the outer periphery of the shaft 6, FIG. 2. The outer periphery of the side of the annular member 3, remote from the annular member 5 in the assembled supporting mechanism 1, preferably is chamfered to afford a surface 19 that slopes radially inwardly from the outer periphery of the annular member 3 on that side of the latter, for a purpose which will be discussed in greater detail presently.

The openings 10 and 16 through the annular members 5 and 3, respectively, preferably are of such size that, in the assembled supporting mechanism 1, the shaft 6 is disposed therein with a relatively snug, but freely slidable fit. In the assembled supporting mechanism 1, the annular members 3 and 5 are so disposed relative to each other, axially of the shaft 6, that when the tubular member to be supported thereon, such as the tubular member 2, is disposed in operative position on the supporting mechanism 1, one end portion thereof is disposed around and supported by the central body portion 7 of the annular member 5 and is abuttingly engaged with the inner radial face of the flange 8; and the other end portion of the tubular member 2 is disposed around and supported by the annular member 3, FIG. 1.

The annular member 4 is in the form of a round ring or wheel, having a circular-shaped outer periphery disposed eccentrically around an opening 20 extending therethrough, FIGS. 1 and 4–6. In the assembled supporting mechanism 1, the annular member 4 is disposed on the hub portion 9 of the annular member 5, with the hub portion 9 disposed in the opening 20 with a snug, but freely rotatable fit. The annular member 4 is narrower in width than the distance that the portion 9 projects outwardly away from the body portion 7 of the annular member 5, and in the assembled supporting mechanism 1 is releasably held on the hub portion 9 by suitable fastening means, such as, for example, a snap ring 21, which is effective to hold the annular member 3 in closely adjacent, freely rotatable, relation to the face of the body portion 7 of the annular member 5 remote from the flange portion 8, FIG. 1. Preferably, the outer peripheral surface 22 of the annular member 4 is knurled or is otherwise provided with a roughened or friction surface, as illustrated in FIGS. 1 and 4–6, and the outer peripheral edge of the side of the annular member 4, remote from the body portion 7 of the annular member 5 is chamfered to afford a radially inwardly sloping outer peripheral edge portion 23, FIG. 1, for a purpose which will be discussed in greater detail presently.

In the operation of the supporting mechanism 1, the annular member 5, with the annular member 4 mounted on the hub portion 9 thereof and secured thereto by the snap ring 21, may be mounted on the shaft 6 in position to dispose the face of the flange 8, which is adjacent to the body portion 7, in proper position to abuttingly engage a tubular member, such as the tubular member 2, FIG. 1, in position to dispose the tubular member 2 in the desired position axially of the shaft 6, when the tubular member 2 has been mounted in operative position on the annular members 4 and 5. Thereafter, the annular member 3 may be mounted on the shaft 6 in proper position to supportingly engage the other end portion of the tubular member, such as the tubular member 2, when the latter is disposed in the aforementioned operative position on the annular member 5. The annular member 3 may then be secured in set position on the shaft 6 by abuttingly engaging the set screw 18 with the outer periphery of the shaft 6.

Preferably, the outer periphery of the annular member 4 is slightly larger in diameter than the body portion 7 of the annular member 5, such as, for example, 0.03 inches to 0.06 inches greater. With this construction, when the tubular member 2 is disposed in operative position on the supporting mechanism 1, with the outer peripheries of the annular member 4 and the body portion 7 of the annular member 5 disposed in axial alignment with each other, as shown in FIG. 5, the inner surface of the tubular member 2 is engaged with a portion of the knurled outer surface 22 on the periphery of the annular member 4.

With the annular members 3–5 operatively disposed on the shaft 6, and with the annular member 4 and the body portion 7 of the annular member 5 disposed in axial alignment with each other, wherein the annular member 4 is disposed in its downwardmost position on the shaft 6, as seen in FIG. 5, a tubular member, such the tubular member 2, may be inserted into operative position on the supporting mechanism 1 by moving it axially along the shaft, from left to right, as viewed in FIG. 1, into surrounding relation to the annular members 3 and 4 and the body portion 7 of the annular member 5. During this movement of the tubular member 2 onto the supporting mechanism 1, the chamfered surfaces 19 and 23 of the annular members 3 and 4 afford guide surfaces for expediting the insertion of these members into the tubular member 2 and guiding the tubular member 2 onto the supporting mechanism 1. Preferably, the internal size of the tubular member 2 is such that when it is being inserted onto the supporting mechanism 1, to be disposed around the annular member 4 with a relatively loose fit. For example, when the tubular member 2 is in the form of a core for a roll of paper or film for use in a bag-making machine, or the the like, and the outside diameter of the annular member 4 is in the nature of 3 inches, the internal diameter of the tubular member 2 is in the nature of from 3.05 to 3.1 inches.

With the tubular member 2 thus disposed on the supporting mechanism 1, it may be quickly and easily, releasably locked or secured to the annular member 5 for rotation with the shaft 6. This is accomplished by imparting a relative rotation between the tubular member 2 and the annular member 5 secured to shaft 6 in such direction that the locking action is in a direction opposed to the direction in which the shaft will rotate to perform its function in the machine.

It will be remembered that when such relative rotation between the tubular member 2 and the annular member 5 is commenced, the annular member 4 is disposed in axial alignment with the body portion 7 of the annular member 5 as viewed in FIG. 5, and these members 2 and 5 will be eccentric with respect to the shaft 6. The aforementioned relation rotation between the tubular member 2, and the annular member 5 by reason of the frictional engagement between the member 2 and a portion of the outer periphery of the annular member 4, is effective to rotate the latter from its concentric position with respect to the member 5 shown in FIG. 5 toward its maximum eccentric position, shown in FIG. 6. Such movement is effective to move the annular member 4 from its aforementioned axially aligned relation to the body portion 7 of the annular member 5 to an increasingly eccentric relation to the body portion 7. This, of course, causes lateral movement of the tubular member 2 relative to the body portion 7 of the annular member 5, and when the amount of eccentricity of the annular member 4 relative to the body portion 7 has increased to an amount equal to the amount that the internal diameter of the tubular member 2 exceeds the external diameter of the annular member 4, continued rotation of the annular member 4 is effective to positively engage the internal surface of the tubular member 2 with that portion of the outer periphery of the body portion 7 which is disposed on the side of the shaft 6 remote from the eccentricity of the annular member 4 relative to the body portion 7 to thereby afford an outwardly expanding or wedging engagement of a portion of the surfaces of the annular member 4 and the body portion 7 with the interior of the tubular member 2, and thereby firmly secure the tubular member 2 to the annular member 5 for rotation in that same direction. The continued application of an external rotating force to the tubular member 2 in the aforementioned direction is effective to tend to increase the force with which the annular member 4 and the body portion 7 wedgingly or clampingly abuttingly engage the interior of the tubular member 2. When it is desired to release the tubular member 2 from the aforementioned latched or locked relation to the annular member 5, it is merely necessary to relatively rotate the tubular member and the annular member 5, in the opposite direction, to thus frictionally drive the annular member 4 around the hub 9 back toward the aforementioned position wherein it is disposed in axial alignment with the body portion 7, as viewed in FIG. 5.

Preferably, the external dimensions of the annular member 4 and the hub portion 9 are such that, when a tubular member, such as the tubular member 2 is disposed on the annular member 4 with the aforementioned loose, but relatively snug fit, when movement of the annular member 4 from its original position, as shown in FIG. 5, toward its most extreme operated position, as shown in FIG. 6 is sufficient to latchingly engage the tubular member 2 by the annular member 4 and the body portion 7, the annular member 4 has advanced around the hub portion 9 into such position that the tubular member 2 is disposed in substantially radially centered position relative to the shaft 6, as shown in FIG. 4. This is made possible by the double-eccentric mounting afforded by the eccentric positioning of the hub portion 9 and the annular member 4 relative to the shaft 6, which provides a much greater wedging and locking action than would be the case if the hub member 9 were concentric to the shaft 6, with the annular member 4 merely being eccentrically mounted thereon.

However, we have found that by constructing the supporting mechanism 1 in the manner disclosed herein, the rotation of the annular member 4 on the hub portion 9 is such that during rotation of the annular member 4 from its position concentric with the body portion 7 and eccentric with shaft 6, as shown in FIG. 5, to its position of maximum eccentricity with respect to the body portion 7, as shown in FIG. 6, it moves toward and substantially into, and then away from a centered relation to the shaft 6, such as shown in FIG. 4. This is by reason of the fact that with the annular member 4 commencing such rotation from a position wherein it is downwardly eccentric to both the shaft 6 and the hub portion 9, FIG. 5, and with the hub portion 9 being upwardly eccentric to the shaft 6, as the lowermost point on the outer periphery of the annular member 4 moves around the hub portion 9 in a movement which would be effective to circumscribe a circle relative thereto, the upwardly eccentric positioning of the hub member 9 on the shaft 6 is effective to move that point upwardly relative to the shaft 6, and, therefore, relative to the flange 8, which is concentric thereto. At a point during such rotation of the annular member 4, between the lowermost position thereof, as shown in FIG. 5, and the uppermost position thereof, as shown in FIG. 6, the upwardly off-set rotation of the annular member 4, by reason of its eccentric rotation around the hub portion 9, which, itself is eccentric relative to the shaft 6, is effective to move the circular-shaped periphery of the annular member 4 toward axially-centered position relative to the outer periphery of the flange 8. If this latter position is the position in which the tubular member 2 is wedgingly secured to the shaft 6 by the annular member 4 and the body portion 7, the tubular member 2 is thus disposed in substantially concentric relation to the shaft 6, as shown in FIG. 4.

We have found, for example, that with the flange portion 8 having an outside diameter of 3.5 inches; the body portion 9 having an outside diameter of 2.93 inches; the body portion 9 having an outside diameter of 2.93 inches; the annular member 4 having an outside diameter of 2.97 inches; the hub portion 9 having an outside diameter of 1.5 inches; the shaft 6 having an outside diameter of 1.00 inch; the hub portion 9 being off-set in one direction 0.08 inch relative to the opening 10, and the body portion 7 being off-set 0.04 inch in the opposite direction relative to the opening 10; and the annular member 4 being off-set 0.12 inch relative to the opening 20, the aforementioned wedgingly-engaged, substantially centered relation of the tubular member 2 on the annular member 5 will be effected by a rotation of between approximately 60° and 70° of the annular member 4 around the shaft 6, when the tubular member 2 has an internal diameter which is between 0.03 inch and 0.06 inch greater than the outside diameter of the annular member 4, and the tubular member 2 is so constructed or made of such material that there is substantially no deformation of the tubular member 2 by reason of the wedging force applied thereto by the annular member 4 and the body portion 7.

As will be appreciated by those skilled in the art, although the supporting mechanism 1 has been described herein primarily as though it were to be used for supporting a tubular member from which material is to be fed, such as, for example, a roll of paper or film, from which the paper or film is to be supplied in the operation of a bag-forming machine, or the like, this is merely by way of illustration, and not by way of limitation. It also affords a supporting mechanism which may be used for driving a tubular member, such as the tubular member 2, from a drive shaft, such as the drive shaft 6. It is particularly useful for such a purpose in driving a tubular member to which an external force is applied which resists such rotation, such as, for example, a roller on which paper, film or other material is to be wound, or, a tubular member which it is desired to rotate while applying an external force thereto such as, for example, in polishing or burnishing the outer peripheral surface thereof, and the like. In such a driving operation, the external force on the tubular member 2, together with its frictional engagement with the annular member 4 is effective to rotate the annular member 4 into the aforementioned locking or latching position on the hub 9; and a reverse force on the tubular member 2 is effective to rotate the annular member 4 back into the position wherein the tubular member 2 is released from such locking or latching engagement and may be axially removed therefrom.

Also, as will be appreciated by those skilled in the art, although the supporting mechanism 1 is illustrated in the drawings and has been hereinbefore described as being mounted on a shaft 6, which is disposed in horizontally extending position, this is merely by way of illustration and not by way of limitation, and the shaft may be disposed in other positions, even including a vertical position, without departing from the purview of the present invention. For example, the shaft 6 could be disposed in a position 90° removed, in a clockwise direction, from the position shown in FIG. 1. In such position the shaft would extend vertically, with the annular member 3 disposed above the annular member 4, and with the tubular member 2 resting on the then upper face of the flange portion 8. Under such conditions, if the initial engagement of the annular member 4 with the interior surface of the tubular member 2 is not sufficiently tight to effect rotation of the annular member 4, during initial rotation of the tubular member 2, into the aforementioned latching or locking position, a lateral force on the tubular member 2, perpendicular to the length of the shaft 6, may be applied thereto manually, or otherwise, which is effective to afford the initial frictional engagement between the tubular member 2 and the annular member 4 for effecting the latching or locking rotation of the annular member 4 on the hub portion 9. Reverse rotation of the tubular member 2 and the annular member 4 relative to the annular member 5 with the effective to release the locking engagement of the annular member 4 and the body portion 7 with the interior of the tubular member 2.

In addition, as will be appreciated by those skilled in the art, although the supporting mechanism 1 is illustrated herein as embodying spaced annular members disposed at respective ends of a tubular member, the annular member 3 may be dispensed with, and the annular members 4 and 5 may be made of such size as to afford the entire support for the tubular member 2, without departing from the purview of the broader aspects of the present invention. This is particularly true with respect to affording a support for certain types of tubular members, such as, for example, feed rollers, and the like, the speed of rotation of which is relatively low, so that the radially off-set relation of the annular member 4 and the portions 7 and 9 of the annular member 5 relative to the shaft 6, even when they are not balanced, do not pose any particular problem with respect to vibration, and the like, during rotation of the shaft 6. Under such circumstances, for example, the widths of the body portion 7 and the annular member 4 could be such that they extend across substantially the entire axial length of the tubular member 2, so as to afford a firm support against axial tilting of the tubular member 2 relative to the shaft 6.

From the foregoing it will be seen that the present invention affords a novel supporting mechanism for rotatably supporting a tubular member on a shaft.

In addition, it will be seen that the present invention affords a novel supporting mechanism which is effective, in a novel and expeditious manner, to automatically lockingly engage and release a tubular member upon rotational forces being applied to the tubular member relative to the supporting mechanism in respective opposite directions.

In addition, it will be seen that the present invention affords a novel supporting mechanism for tubular members which is practical and efficient in operation, and which may be readily and economically produced commercially.

Thus, while we have illustrated and described the preferred embodiment of our invention, it is to be understood that this is capable of variation and modification, and we therefore do not wish to be limited to the precise details set forth, but desire to avail ourselves of such changes and alterations as fall within the purview of the following claims.

We claim:

1. A support for rotatably supporting a tubular member comprising a. an elongated shaft, b. an annular member mounted on and extending around said shaft in eccentric relation thereto, c. a second annular member mounted on and extending around said shaft in eccentric relation thereto, and d. a third annular member mounted on and extending around said shaft, e. said annular members being of smaller outside diameter than the inside diameter of such a tubular member and being insertable into said tubular member, f. a fourth annular member mounted on said shaft for rotation therearound and eccentric thereto in a direction different from the direction of eccentricity of said first mentioned annular member, and g. said second annular member being rotatable around said fourth annular member relative to said first mentioned annular member into position wherein said first mentioned and said second annular members are effective to apply angularly displaced outwardly directed forces on the interior of said tubular member mounted thereon for securing said tubular member against rotation relative to said first mentioned and second annular members.

2. A support as defined in claim 1, and in which a. said fourth annular member is eccentric to said shaft in the opposite direction to that in which said first mentioned annular member is eccentric to said shaft.

3. A support for rotatably supporting an elongated substantially straight tubular member on an elongated shaft extending longitudinally through said member, said support comprising, a. two annular members mounted on said shaft in surrounding relation thereto for insertion into such a tubular member in supporting relation to respective end portions thereof, b. said annular members being secured to said shaft for rotation therewith, c. an annular hub portion integral with one of said members and extending axially therefrom, said hub member having a substantially circular outside circumference smaller than said one member and eccentrically disposed relative to said shaft, d. a third annular member mounted on said hub portion in surrounding relation thereto for insertion into said tubular member in supporting relation thereto, e. all of said annular members having substantially circular outer peripheries, and f. said third member being rotatable around said hub portion and shaft relative to said one member between 1. one position wherein the outer peripheries of said third and one members are disposed substantially in axial alignment with each other for receiving said tubular member thereon, and 2. another position wherein the outer peripheries of said third and other members project outwardly beyond each other in different directions for positively abuttingly engaging the outwardly projecting portions of said third and one members with the interior surface of said tubular fmember and thereby releasably locking said tubular member thereon for rotation with said third and other members.

4. A support as defined in claim 3, and in which a. said said one member and said hub portion are eccentric to said shaft in opposite directions, b. said outer periphery of said third member is 1. eccentric to said shaft in the same direction as said outer periphery of said one member when said third member is disposed in said one position, and 2. eccentric to said shaft in a direction which is between said same direction and the direction which is directly opposite to that of said outer periphery of said one member when said third member is disposed in said other position.

5. A support as defined in claim 4, and in which a. said outer periphery of said third member is eccentrically disposed relative to the outer periphery of said hub portion.

6. In a support for rotatably supporting an elongated, substantially straight tubular member on a substantially horizontally extending, elongated shaft extending longitudinally therethrough, the combination of a. an annular member 1. mounted on said shaft in surrounding relation thereto, and 2. secured to said shaft for rotation therewith, b. said annular member comprising 1. a central body portion, 2. a radially outwardly projecting flange at one side of said body portion, and 3. a hub portion of smaller circumference than said body portion projecting outwardly from the side of said body portion remote from said flange, c. the outer peripheries of said body portion and said hub portion being eccentric to said shaft in different directions, d. another annular member 1. mounted on the outer periphery of said hub portion, and 2. having an outer periphery that is eccentric to said outer periphery of said hub portion e. said other annular member being rotatable around said outer periphery of said hub portion between 1. one position wherein said outer periphery of said other member is disposed in axial alignment with said outer periphery of said body portion in position to receive said tubular member on said last mentioned peripheries in surrounding relation thereto and with said tubular member disposed in axially abutting engagement with said flange, and 2. another position wherein said outer peripheries of said other member and of said body portion are eccentric in different directions to said shaft in position to positively abuttingly engage the internal surface of said tubular member so mounted thereon for locking said tubular member, said other member and said body portion together for rotation with each other.

7. The combination defined in claim 6, and in a. the outer peripheries of said body portion and said hub portion are eccentric to said shaft in opposite directions, and b. the outer periphery of said other member is eccentric to said shaft 1. in the same direction as said outer periphery of said body portion when said other member is disposed in said one position, and 2. in a direction between said same direction and a direction directly opposite thereto when said other member is disposed in said other position, and c. when said tubular member is disposed on said other member and said body portion, with said other member disposed in said one position, it is disposed thereon with a loose fit, and d. the total width of the maximum combined space between said tubular member and two opposite sides of said other member, when said other member is disposed in said one position, is less than the total combined eccentricity of said outer peripheries of said body portion and said other member to said shaft, when said outer peripheries of said body portion and said other member are eccentric to said shaft in directly opposite direction.

8. The combination defined in claim 6, and in which a. said tubular member is substantially concentric to said shaft when said other member is disposed in said other position.

* * * * *

UNITED STATES PATENT OFFICE

CERTIFICATE OF CORRECTION

Patent No. 4,058,268 Dated November 15, 1977

Inventor(s) Ralph P. Puccetti and King L. Klopfenstein

It is certified that error appears in the above-identified patent and that said Letters Patent are hereby corrected as shown below:

Col. 1, line 15, "supported" should be --supporting--;
Col. 1, line 42, "he" should be --the--;
Col. 5, line 3, "to be" should be --it is--;
Col. 6, lines 60-61, delete "the body portion 9 having an outside diameter of 2.93 inches;"; and
Col. 9, Claim 2, line 48, "fmember" should be --member--.

Signed and Sealed this

*Twenty-first* Day of *February 1978*

[SEAL]

*Attest:*

RUTH C. MASON
*Attesting Officer*

LUTRELLE F. PARKER
*Acting Commissioner of Patents and Trademarks*